US005308047A

United States Patent [19]

Lonardi et al.

[11] Patent Number: 5,308,047

[45] Date of Patent: May 3, 1994

[54] MACHINE FOR PIERCING A TAPHOLE FOR A SHAFT FURNACE

[75] Inventors: Emile Lonardi, Bascharage; Jean Metz, Pierret; Pierre Mailliet, Drosbach; Guy Thillen, Diekirch; Radomir Andonov, Mamer, all of Luxembourg; Philippe Malivoir, Thionville, France

[73] Assignee: Paul Wurth S.A., Luxembourg, Luxembourg

[21] Appl. No.: 8,129

[22] Filed: Jan. 22, 1993

[30] Foreign Application Priority Data

Jan. 27, 1992 [LU] Luxembourg ..... 88060

[51] Int. Cl.[5] ..... C21C 5/48

[52] U.S. Cl. ..... 266/271; 266/45

[58] Field of Search ..... 266/45, 271, 272, 273

[56] References Cited

U.S. PATENT DOCUMENTS 4,602,770 7/1986 Mailliet et al. ..... 266/271
4,960,379 10/1990 Schneider ..... 266/45
5,069,430 12/1991 Woodings et al. ..... 266/271

*Primary Examiner*—Scott Kastler
*Attorney, Agent, or Firm*—Fishman, Dionne & Cantor

[57] ABSTRACT

A machine is provided for piercing a taphole for a shaft furnace for applying the piercing rod method. The machine comprises a mounting, with a support for supporting the rod at the front of the mounting, a sliding support for supporting the rod at the rear of the mounting and a clamp, mounted in a sliding manner on the mounting and designed for gripping the rod at any place between the front support and the rear support. A travel multiplier is connected between a jack and the clamp so that the clamp may be moved. Means for controlling the jack make it possible to move the clamp in a to-and-fro motion between a position (B) at the front of the mounting and a position (A) which is located at a distance L from the position (B).

13 Claims, 2 Drawing Sheets

MACHINE FOR PIERCING A TAPHOLE FOR A SHAFT FURNACE

BACKGROUND OF THE INVENTION

The present invention relates to a machine for piercing a taphole for a shaft furnace. More particularly, this invention relates to a machine for the lost rod method used for piercing a taphole for a shaft furnace used in the production of steel. The lost rod method comprises blocking the taphole with taphole clay. Before the taphole clay has fully hardened, a metal rod is driven into and through this clay to a desired distance into the shaft furnace. At the appropriate time, the metal rod is extracted to open the taphole.

The machine of the present invention comprises a mounting which has a support for the piercing rod at the front end. A rear support which can move slidably on the mounting is provided with coupling means for the rear end of the piercing rod. A clamp is provided which is slidable on the mounting and is designed to grip the piercing rod at any place between the front support and the rear support.

The prior art machines used previously to the present invention for this lost rod method are substantially conventional drilling apparatuses (i.e., drilling apparatuses designed for working with a drill bit). These conventional drilling machines have undergone appropriate adaptations and modifications to make them suitable for use in the lost rod method.

The main working members of these drilling machines is comprised of a chuck, a coupling clamp for the piercing rod, and a bi-directional pneumatic hammer. It will be appreciated that a high powered pneumatic hammer is required to deliver the large forces necessary for the insertion and extraction of the lost piercing rod.

In most cases, the above machines do preserve the possibility of being able to use a drilling apparatus with a bit. This feature is desirable in the cases where a taphole must be reformed or the taphole's location must be changed. Also, it is desirable to be able to work with a conventional bit if for some reason or another, the lost rod method cannot be used.

However, a powerful, large pneumatic hammer, as is used on these machines, is not without considerable drawbacks. One major drawback is that the pneumatic hammer exerts considerable amount of stresses and vibrations on the equipment. As a result, in particular, the rod-coupling clamp is subjected to rapid wear. Another major drawback is that the pneumatic hammer is extremely noisy, and very often cannot conform to ever-stricter standard aimed at reducing the noise level in an industrial environment.

The patent application EP-0-379-018 corresponding to U.S. application Ser. No. 462,415 filed Jan. 9, 1990, all the contents of which are incorporated herein by reference, provides an excellent method for extracting the piercing rod from a shaft furnace. This method relies on the action of a silent hydraulic jack to extract the piercing rod in several phases by means of a to-and-fro motion of a clamp acted upon by this silent hydraulic jack. This eliminates the need of a bi-directional pneumatic hammer since the pneumatic hammer is no longer required for use in the extraction of the piercing rod. The pneumatic hammer is still, however, required for efficient and rapid installation of the piercing rod.

The disadvantages of the pneumatic hammer, previously discussed, makes it desirable to eliminate the percussion of the pneumatic hammer during the insertion phase of the piercing rod into the taphole. It is possible to subject the working member to a much more powerful driving means to advance the working member coupled to the piercing rod along the mounting in the direction of the taphole without vibrations into the semi-hardened sealing clay. Unfortunately, because of the length of the piercing rod, a too strong driving force can cause the piercing rod to buckle and could then be permanently blocked in a position which would not allow the piercing rod to be further driven into or extracted from the rapidly hardening taphole clay.

A better solution to the foregoing problem as discussed above, is suggested in the Luxembourg patent application LU-87-915, filed on Apr. 3, 1991, corresponding to U.S. application Ser. No. 862,487 filed Apr. 2, 1992, all the contents of which are incorporated herein by reference. This patent application comprises a bi-directional clamp whose reciprocating to-and-fro motion, produced by a hydraulic jack at the front of the mounting, is used both for the insertion and for the extraction of the piercing rod. The U.S. Ser. No. 862,487 does make it possible to eliminate the noisy and clamp-damaging pneumatic hammer. A disadvantage of the machine described in U.S. Ser. No. 862,487 is that the bi-directional clamp and the means which actuate the bi-directional clamp always operate in the front region of the mounting. However, this region is a zone which is at risk of being splashed when the molten jet stream escapes from the taphole after extraction of the rod.

The problem of damage due to splashing in the preceding paragraph is resolved in Luxembourg patent application LU-88-029, filed Oct. 31, 1992, corresponding to U.S. application Ser. No. 968,984 filed Oct. 30, 1992, all the contents of which are incorporated herein by reference. This machine basically comprises two jacks. The first jack is mounted in a sliding manner on the mounting in such a way that the first jack can move along the mounting when urged by the second jack. The piercing rod is no longer extracted by a reciprocating to-and-fro motion of the clamp, but by a continuous withdrawal motion of the clamp under the combined action of the two hydraulic jacks. The clamp is cleared from the splash zone at the front of the mounting before the molten jet stream escapes from the taphole. A further advantage is that the extraction of the piercing rod is much speedier, since the extraction is carried out by a continuous movement compared to intermittent movement involved in the to-and-fro movement by the clamp previously used.

The above-mentioned U.S. application Ser. No. 968,984 only is involved in the extraction of the piercing rod. The piercing rod is inserted in the same manner as depicted in U.S. application Ser. No. 862,487. The clamp used in inserting the piercing rod under the U.S. application Ser. No. 862,487 patent is acted upon with a reciprocating to-and-fro motion under the action of the first jack, after the first jack has been advanced into the operative position by the second jack.

The method for extraction of the piercing rod provided in U.S. application Ser. No. 968,484 provides satisfactory operation. A drawback of U.S. application Ser. No. 968,984 is that there is a considerable increase in the overall length of the machine. This is not desirable and can interfere with operations because of the lack of available space around the shaft furnace. In addition, the superposition of two jacks results in considerable lever arms in transmission of the forces, resulting in very significant contact pressures at the sliding members.

SUMMARY OF THE INVENTION

The above-discussed and other drawbacks and deficiencies of the prior art are overcome or alleviated by the machine for piercing a taphole for a shaft furnace of the present invention. The aim of the present invention is to provide a machine that can both drill a taphole for a shaft furnace and can also implement the lost rod method similar to U.S. application Ser. No. 968,984. The present invention substantially reduces the overall length with respect to the machine provided for in U.S. application Ser. No. 968,984.

The present invention comprises a machine designed for drilling a taphole, with a jack with the ability to travel a distance C installed on a mounting. A travel multiplier is connected between the jack and clamp so that the clamp may be driven over a distance 2C along the mounting. Means are also provided to control the jack's movements so as to move the clamp in a to-and-fro motion between a position B at the front of the mounting and a position A located at a distance L from position B, the distance L being less than the length of the piercing rod. A basic feature of the present invention is that a jack with travel C acts via a travel multiplier on a clamp sliding along a mounting so that the clamp is thus able to travel a distance of 2C.

It will be appreciated that the machine according to the present invention is compatible with the piercing rod insertion and extracting method described by U.S. application Ser. No. 968,984.

A preferred embodiment in accordance with the present invention comprises a hydraulic cylinder actuator, connected to a travel multiplier mechanism which is connected to a movable carriage installed slidably in a mounting with chain means. The arrangement of the jack and carriage on the mounting reduce the overall length of the machine to approximately the length of the piercing rod used in the lost rod method.

A summary of the operation of the present invention follows below. The piercing rod is passed through a clamp (attached to the carriage) and is coupled to a support slidable at the rear of the mounting. The open clamp is brought to a distance L from the front of the mounting. The clamp is closed and the piercing rod is made to advance by means of the clamp by a length L so as to drive the piercing rod into the taphole clay. The clamp is then opened and the open clamp is brought back once again to the distance L from the front of the mounting. The clamp is again closed and the piercing rod is made to advance by a second length L. This to-and-fro motion of the clamp over the distance L is repeated until the piercing rod is driven into the taphole by the desired length.

The distance L is determined so as to prevent the buckling of the piercing rod during its insertion into the taphole.

The piercing rod is extracted by firmly attaching the end of the piercing rod to the clamp when the clamp is positioned at the front of the mounting. It is pulled out by the chain clearing the piercing rod in a continuous movement from the taphole.

To extract the rod in a continuous motion by means of the clamp, it is clear that the travel of the clamp on the mounting must correspond approximately to the length of the piercing rod.

To carry out this extraction motion by means of a single jack, without a travel multiplier, this single jack would need to have a travel path equal to the length of the piercing rod. This jack must necessarily be mounted behind the clamp requiring an overall length of such a machine that would be equal to more than twice the length of the piercing rod. However, the jack of the present invention only needs a travel path which corresponds only to half the length of the piercing rod. Even if a travel multiplier were chosen which can act only in front of the jack, the overall length of the machine would be a maximum of 1.5 times the length of the piercing rod.

The design of a preferred embodiment of the present invention provides a particularly simple and strong travel multiplier which is especially suitable for use in the harsh and polluted environment surrounding a shaft furnace. The multiplier comprises as its only elements, a moveable carriage installed in a sliding manner in the mounting and a chain.

In addition, it is possible to reduce the overall length of the machine to approximately the length of the piercing rod by the particular arrangement of the jack and carriage on the mounting of this invention.

Another feature of the present invention is the simplicity with which control of the various movements of the jack is achieved. The jack designed for this invention achieves control by means of only three hydraulic conduits. Further, there is no need for any end-of-travel switches for controlling the movement of the clamp.

By virture of the travel multiplier, the speed of the clamp is twice the speed of the jack. Naturally, the force which the jack must produce to advance the clamp is also equal to twice the reaction force encountered by the clamp. It is therefore possible to vary the supply pressure of the jack in order to increase substantially the on-load speed of the clamp without necessarily increasing the hydraulic fluid consumption of the jack. The on-load speed of the clamp is in any case twice the no-load speed of a clamp connected to a jack which has the same dimensions and which operates under the same hydraulic fluid supply pressure. This is a substantial advantage, especially for the piercing rod insertion operation. Indeed, the time required for the successive returns of the clamp to a distance L from the front of the mounting is halved.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
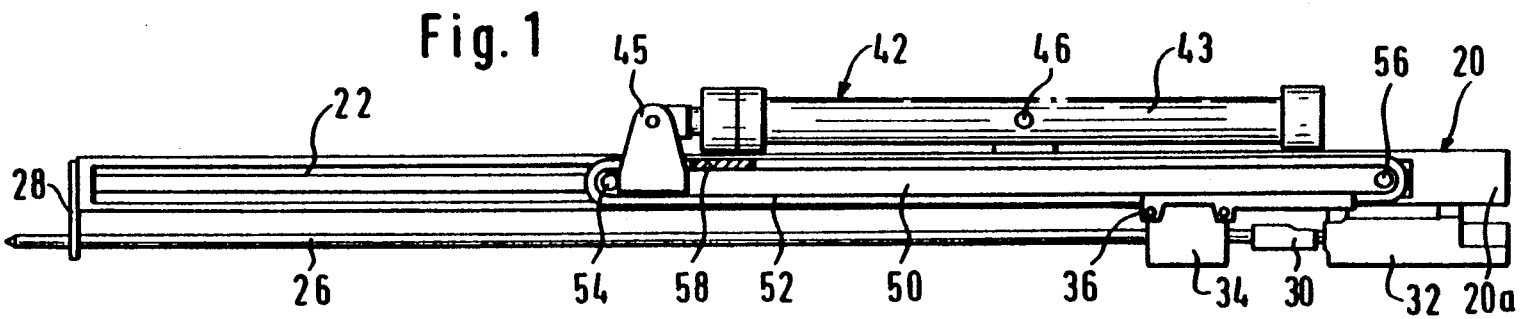
FIG. 1 shows a longitudinal section through the machine for piercing a taphole for a shaft furnace according to the present invention, shown in the position in which the machine is prepared for the insertion of a piercing rod into the taphole clay.
Figure 2:
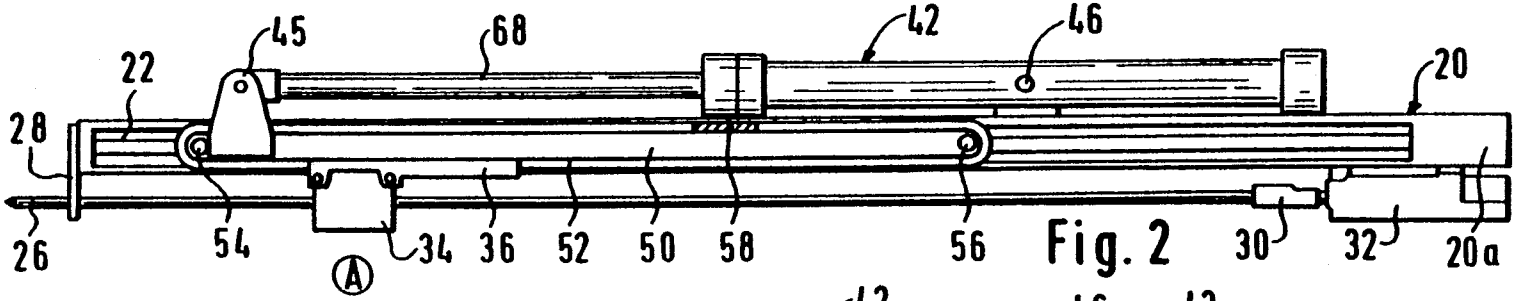
FIG. 2 shows a longitudinal section through the machine of FIG. 1, just before the first piercing rod insertion movement.
Figure 3:
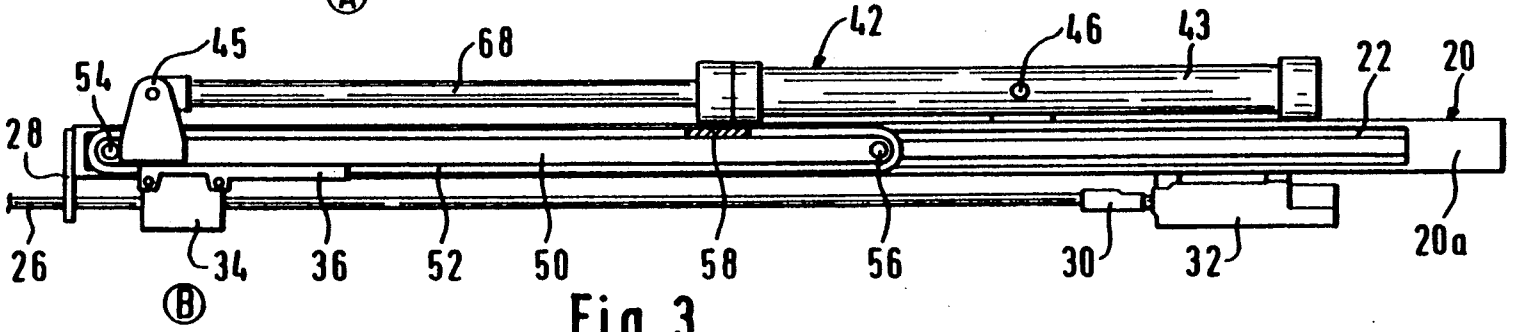
FIG. 3 shows a longitudinal section through the machine of FIG. 1, just after the first piercing rod insertion movement.

Referring to FIGS. 1, 2 and 3, a preferred embodiment of a machine for piercing a taphole for a shaft furnace is shown in longitudinal section. The framework of the piercing machine comprises a mounting 20. This mounting is, e.g., supported in a conventional and known manner at the end of a supporting arm (not shown). This supporting arm may pivot about a bracket in order to move the piercing rod machine between a parked position and an operative position and vice versa.

The mounting 20 may be formed by two parallel beams 20*a*, 20*b* joined together. On the FIGURES, only the beam 20*a* can be seen, the beam 20*b* is left out to show more details. The two beams 20*a* and 20*b* comprise, on their inner face, two rails 22 and 24 arranged face to face. Only rail 22 is shown in FIG. 1.

Item 26 designates a piercing rod, still called a lost rod, for the methods described herein. This piercing rod 26 is carried at the front of the machine in a support, which may e.g., be a sliding support of the type described in patent GB-2-216-827, corresponding to U.S. Pat. No. 5,039,068, all the contents of which are incorporated herein by reference.

It is also possible to use a fixed support 28 of the type described in the European patent application EP-0-064-644. This support 28 comprises two flaps fastened at the front of the mounting 20 and is capable of pivoting between an open position facilitating the engagement and grasping of the piercing rod 26 for the extraction operation and a position in which an opening between the flaps is defined for the passage and support of piercing rod 26. The two flaps constitute a support as well as a shield providing protection against splashes caused by the jet stream from the taphole.

At the rear of the piercing machine, the piercing rod 26 is supported by a second support which can follow the movement of the piercing rod. A coupling 30 is firmly attached to working member 32 which is supported by a carriage sliding freely along the mounting 20 on slideways mounted on the flanges of the beams 20*a* and 20*b*.

Working member 32 comprises, in a conventional manner, a drilling apparatus and a hammer not normally used in the lost rod method. Its presence is justified to maintain the capability of drilling a taphole, if need be, with a conventional bit. If conventional drilling is not required or if this drilling can be carried out in another manner, working member 32 may be eliminated. In this case, working member 32 is replaced by a simple sliding support following and supporting piercing rod 26 from the rear of the mounting 20.

Clamp 34 may be e.g., a bi-directional clamp such as is described in U.S. application Ser. No. 862,487. Clamp 34 is supported by carriage 36 mounted on slideways which are firmly attached to the flanges of beams 20*a* and 20*b* or other suitable arrangement.

On the mounting 20 is secured hydraulic jack 42, whose travel C corresponds approximately to half the length of piercing rod 26. Jack 42 includes a body 43 fixed in accordance with the state of the art at 46 to mounting 20. Piston rod 68 is joined at 45 in accordance with the state of the art to a travel multiplier. Note that when piston rod 68 is completely extended from jack 42, the jack has a total length equal approximately to the length of piercing rod 26.

It would be possible to select any travel multiplier (1) which is of simple and rugid construction, (2) which can be easily built into the mounting 20, and (3) which results in an overall length of the machine which can be limited to the length of the piercing rod 26. A travel multiplier which fulfills these three conditions is described below by way of example only.

This preferred travel multiplier includes a carriage 50 sliding, for example by means of runners (not shown) in the rails 22 and 24 mounted on the internal flanks of the beams 20*a* and 20*b* forming the mounting 20. This carriage 50 comprises a wheel 54 at its front end and a wheel 56 at its rear end. These two wheels 54 and 56 are used to tension an endless chain 52 which is fixed by its upper strand to the mounting 20. It will be noted that this point where the chain 52 is fixed to the mounting 20, marked on FIGS. 1 to 3 by reference 58, is located approximately half way along the mounting. The travel of the carriage 50 is consequently centered with respect to the mounting 20. The lower strand of the chain is firmly attached to the carriage 36.

It will be appreciated that in the present invention, the jack 42, the carriage 50 and the carriage 36 have been organized in such a way that when the piston rod 68 is fully retracted, the jack 42 and the carriage 50 are superimposed over the rear half of the mounting and the carriage 36 is at the place which corresponds to the rear travel limit of the clamp 34. This arrangement is particularly advantageous because (1) the overall length of the machine is substantially equal to the travel of the clamp 34 and (2) at the end of the rod extraction operation, when there is a risk of splashes, the carriage 36, the carriage 50 and the piston rod 68 are in a position which is retracted with respect to the front of the mounting 20.

It will be understood that, when the carriage 50 is moved by a distance X in a first direction, each point of the lower strand of the chain 52 undergoes a displacement 2X with respect to the mounting in the first direction. This displacement 2X can be more accurately broken down into a relative displacement X of the point of the chain with respect to the carriage 50 which is added to a relative displacement X of the carriage 50 with respect to the mounting 20.

It will be appreciated that the chain could be replaced by cables, but this solution would increase the constructional height of the carriage 50 since the cable winding diameter must be selected so as to be substantially greater than that of a chain. It would also be possible to connect two travel multipliers in series so as to further reduce the length of the jack 42. This would have no influence, however, on the overall length of the machine since the mounting 20 which must carry the piercing rod 26 must in any event have the length of the piercing rod 26.

The operation of the machine for inserting the piercing rod 26 into the taphole and for extracting it therefrom is described below. The piercing rod 26 is preferably loaded into the machine when the latter is in the parked position and when the clamp 34 occupies a position at the rear of the mounting, as shown in FIG. 1. The loading is performed by passing the piercing rod 26 through the open clamp 34 into the support-coupling 30 which is firmly attached to the working member 32.

When the piercing rod 26 is in place according to FIG. 1, the jack is actuated and the piston rod 68 extends in order to advance the clamp 34, which is fully open, into a position A according to FIG. 2. Since the clamp 34 is not activated, it can slide freely with respect to the piercing rod 26 which is held in the coupling 30 of the working member 32.

In principle, it would be possible to advance the clamp 34 into the operative position A according to FIG. 2 before loading the piercing rod 26, but it is easier to engage the piercing rod 26 when the clamp 34 occupies a position at the rear of the mounting according to FIG. 1.

From the position in FIG. 2, it is possible to begin the process of inserting the piercing rod 26 into the taphole clay. This operation takes place according to the same method as that described in U.S. application Ser. No. 862,487. For this purpose, the jack 42 and the clamp 34 are activated simultaneously, which has the effect of (1) closing the clamp 34 and (2) moving it from the position A in FIG. 2 to the position B in FIG. 3 by means of an additional extension by a length L/2 of the piston rod 68. This movement advances the rod by a length L which penetrates by its front end into the taphole clay and by its rear end drives the working member 32. When the position B is reached, it is necessary to (1) open the clamp 34 and (2) make it withdraw by a retraction of the piston rod 68 of the jack 42. During this return motion, the rod 26 remains immobile, given that the clamp 34 is open and can thus slide along the piercing rod 26.

When the carriage 36 arrives in the position A during its return stroke, it is necessary that (1) the clamp 34 is closed and (2) the piston rod extends once again by a length L/2 so as to move the clamp 34 to the position B in FIG. 3 and drive the piercing rod 26 by a length L into the taphole clay. This to-and-fro motion of the clamp 34 between the position A and the position B is then repeated as many times as necessary for inserting the piercing rod 26 by the desired length into the taphole.

In order to extract the piercing rod from the taphole, the mounting 20 is moved towards the taphole. The bidirectional clamp 34 is brought by the jack 42 to the front of the mounting, that is to say into the position B. When the mounting is correctly positioned, the free end of the piercing rod 26 is engaged through the clamp 34 which is open. The circuit supplying the clamp 34 is then reversed so that the clamp 34 is closed. The jack 42 can now pull the carriage 36 supporting the clamp 34 rearwards and thus extract the rod from the taphole.

It should be noted that this time the carriage 36 reaching the position A in FIG. 2 does not cause releasing of the clamp and reversal of the jack motion, but that the extraction is carried out in one stroke, until the jack 42 is fully retracted.

The present invention, however, in another alternative embodiment designed for the extraction operation, makes it possible to use the coupling 30 of the working member 32. It should be noted that this was judged to be impossible up until now because it is well known that the working member 32 is not normally sized to transmit a large traction force to the piercing rod 26.

The coupling 30 is in this alternative embodiment a clamp designed for the extraction of the rod, for example a clamp of the type of that is described in U.S. application Ser. No. 462,415, and the clamp 34 may be a unidirectional clamp, designed for the insertion of the piercing rod 26. The clamp 34 is left open and the free end of the rod 26 passes through it so as to be gripped by the clamp/coupling 30. During its rearward return stroke, the clamp 34 or its carriage 36 bears directly on the coupling 30 and thus pushes the working member 32 in front of it. In view of the fact that the transmission of the traction force takes place directly on the coupling 30 and not on the working member 32, working member 32 does not have to withstand any force. It will simply precede the clamp 34 and the coupling 30 during their withdrawal motion. In this way the construction of the clamp 34 becomes easier since it has to comprise only one pair of jaws. In addition, it has to be connected to only one single pneumatic circuit.

It will be noted further that the carriage 36 supporting the clamp 34 and the working member 32 can be firmly attached together, for example, via two hooks located on each side of the working tool and capable of being engaged manually or automatically with catches located laterally on the carriage 36. Thus the working member 32 does not require a specific driving system on the mounting 20 in order to carry out, for example, a drilling operation with a conventional drill. However, if the working member 32 is not used, it should preferably be locked at the rear of the mounting.

It will be especially appreciated that the present invention also provides a jack which makes it possible to simplify the automatic control of the sequence of these various movements. This jack will be described with the aid of FIGS. 4, 5 and 6.

These three FIGS. (4, 5 and 6) show the jack 42 with its body 43 and its piston rod 68. The body 43 comprises a first chamber 60 of constant cross section, comprising a closed end with a connection 72 for a first hydraulic conduit and an open end near which there is arranged a connection 74 for a second hydraulic conduit. A second chamber 62 prolongs the first chamber 60 in a coaxial manner, but has a cross-section which is slightly greater than chamber 60. It is provided with a connection 76 for a third hydraulic conduit in its closed end which is at the opposite end to the first chamber 60.

The piston-rod comprises three parts which are coaxial with each other, namely: a piston head 64 fitted into the first chamber 60, an intermediate segment 66 having a cross section which is slightly smaller than the head of the piston 64 and a length which is slightly greater than the length of the second chamber and a prolonging rod 68 having a cross section which is slightly smaller than the said intermediate segment 66. This rod 68 prolongs the piston-rod outwards, through the closed end of the said second chamber 62.

A second piston 70 is fitted into the second chamber 62 and can slide on the prolonging rod 68.

Figure 4:
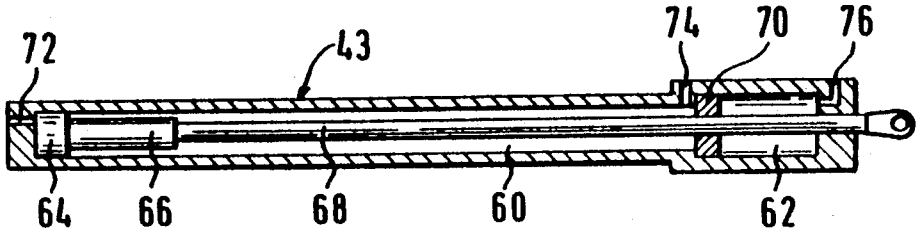
FIG. 4 shows a diagrammatical front elevation sectional view through the centerline of a preferred embodiment of a jack used in the present invention corresponding to the actuated position of the jack shown in FIG. 1.
Figure 5:
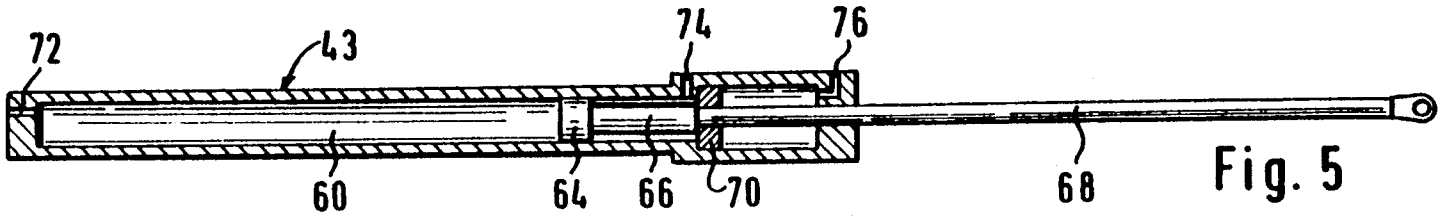
FIG. 5 is the jack of FIG. 4 corresponding to the actuated position of the jack shown in FIG. 2.
Figure 6:
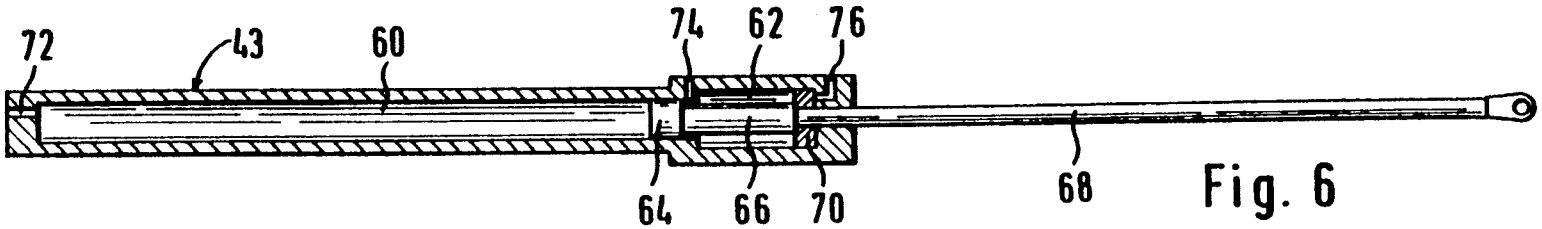
FIG. 6 is the jack of FIG. 4 corresponding to the actuated position of the jack shown in FIG. 3.

It will be noted that:

FIG. 4 corresponds to the position of the jack in FIG. 1, that is to say the clamp is in the rearmost position on the mounting, this position will hereafter be called position 0;

FIG. 5 corresponds to the position of the jack in FIG. 2, that is to say the clamp is in position A at a distance L from the front of the mounting, ready to drive the rod in by the length L;

FIG. 6 corresponds to the position of the jack in FIG. 3, that is to say the clamp is in position B of the mounting, that is to say in the frontmost position.

The various movements are obtained as follows:

(1) in order to advance the clamp from position 0 to position A:

conduit 72 will be pressurized
conduit 74 will be connected to the reservoir
conduit 76 will be closed.

It will be noted that the sliding piston 70 forms an intermediate stop-piece for preventing the piston rod from advancing beyond the position which corresponds to position A of the clamp. This position does not therefore have to be defined by an end-of-travel switch.

(2) in order to advance the clamp from the position A to position B:

conduit 72 will be pressurized
conduit 74 will be connected to the reservoir
conduit 76 will be connected to the reservoir (3) in order to make the clamp withdraw from position B to position A:

conduit 72 will be connected to the reservoir
conduit 74 will be connected to the reservoir
conduit 76 will be pressurized (4) in order to make the clamp withdrawn from position B to position 0:

conduit 72 will be connected to the reservoir
conduit 74 will be pressurized
conduit 76 will be pressurized It should be noted that the conduit 76 is pressurized in order to ensure that the sliding piston 70 returns to the position which it occupies in FIG. 4.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Machine for piercing a taphole for a shaft furnace, according to a method in which, after having plugged the taphole with taphole clay, a metal rod is driven into this clay, before it has fully hardened, and it is extracted, at the desired time, with a view to opening the taphole, the machine comprising:

a mounting having a front and a rear;

a front support for supporting the rod at the front of the mounting;

a sliding rear support for supporting the rod at the rear of the mounting;

a first clamp, mounted in a sliding manner on the mounting, the rod passing axially through said first clamp, said first clamp including means for gripping the rod at any place between said front support and said rear support;

a jack having a travel distance C, the distance C being less than the length of the rod, said jack mounted on the mounting;

a travel multiplier connected between the jack and the first clamp so that the first clamp may be moved by said jack over a distance 2C along the mounting, the distance 2C being two times the travel distance C of the jack; and control means for controlling the jack in order to move the first clamp in a to-and-fro motion between a position (B) at the front of the mounting and a position (A) which is located at a distance L from the position (B), the distance L being less than the length of the rod.

2. Machine according to claim 1 wherein said travel multiplier comprises;

a carriage sliding on the mounting, said carriage having a front wheel and rear wheel; and an endless chain which is fixed with a first strand to the mounting wherein the jack is connected to the carriage and the first clamp is connected to a second strand of the chain, said endless chain is tensioned between said front wheel and said rear wheel.

3. Machine according to claim 2, wherein:

the chain is fixed to the mounting approximately half way along the mounting; and the carriage and the jack are both superimposed when the jack is retracted.

4. Machine according to claim 1 wherein:

said first clamp comprises a pneumatic clamp; and a module for controlling the pneumatic clamp, said module being adapted to open the pneumatic clamp automatically in the position (B) before the return towards the position (A) and to close the pneumatic clamp automatically in the position (A) before the return to the position (B).

5. Machine according to claim 1 wherein said jack comprises:

a first chamber of constant cross-section, said first chamber comprising a closed end with a connection for a first hydraulic conduit and an open end near which there is a connection for a second hydraulic conduit;

a second chamber prolonging the first chamber in a coaxial manner but having a cross section which is slightly greater than the first chamber, said second chamber including a connection for a third hydraulic conduit in a closed end which is at the opposite end to the first chamber;

a piston-rod comprising three parts which are coaxial with each other, including a piston head fitted into the first chamber, an intermediate segment having a cross section which is smaller than the head and a length which is slightly greater than the length of the second chamber, and a rod having a cross section which is smaller than the intermediate segment which it prolongs through the closed end of the second chamber towards the outside; and a piston fitted into the second chamber and sliding on the rod.

6. Machine according to claim 5 wherein said means for controlling the jack comprise:

means for alternately pressurizing the conduits and for joining the conduits which are not pressurized to a reservoir, so as to obtain a to-and-fro motion of the first clamp at the front of the mounting.

7. Machine according to claim 5 including:

means for pressurizing said first conduit, for connecting said second conduit to a tank and for obturating said third conduit, to permit a forward movement of said first clamp towards an intermediate position.

8. Machine according to claim 5 including:

means for pressurizing said second conduit and said third conduit and for connecting said first conduit to a tank to permit the withdrawal of the first clamp from the front of the mounting towards the rear of the mounting.

9. Machine according to claim 1 including:

a working member mounted in a sliding manner on the mounting.

10. Machine according to claim 9, wherein the working member comprises:

a drilling apparatus and a hammer.

11. Machine according to claim 10, further comprises:

a coupling firmly attached to the working member, said coupling comprising a second clamp for gripping the free end of the rod during the operation of extraction of the rod, and wherein the first clamp is provided with a bearing surface bearing directly on the coupling in order to push the working member in front of it during the operation of extraction of the rod.

12. Machine according to claim 10 wherein:

the first clamp being firmly attached to the working member, the working member then being driven by the first clamp with the first clamp being driven by the jack via the travel multiplier.

13. Machine according to claim 1 wherein:

the first clamp is a bidirectional clamp which can be used for gripping the rod equally during the operation of extraction and during the operation of insertion of the rod.

* * * * *